US008382395B2

(12) United States Patent
Glee et al.

(10) Patent No.: US 8,382,395 B2
(45) Date of Patent: Feb. 26, 2013

(54) PAVING SYSTEM AND METHOD FOR CONTROLLING COMPACTOR INTERACTION WITH PAVING MATERIAL MAT

(75) Inventors: Katherine C. Glee, Dunlap, IL (US); Robert Price, Dunlap, IL (US); Everett Brandt, Brimfield, IL (US); William Evans, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 362 days.

(21) Appl. No.: 12/214,702

(22) Filed: Jun. 20, 2008

(65) Prior Publication Data

US 2009/0317186 A1 Dec. 24, 2009

(51) Int. Cl.
*E01C 23/10* (2006.01)
*E01C 23/07* (2006.01)

(52) U.S. Cl. ..... 404/78; 404/84.1

(58) Field of Classification Search ..... 404/75, 404/78, 84.1, 90, 84.5; 700/303
See application file for complete search history.

(56) References Cited

U.S. PATENT DOCUMENTS

| | | | | |
|---|---|---|---|---|
| 3,678,817 | A | 7/1972 | Martenson et al. | |
| 4,473,319 | A * | 9/1984 | Spangler | 404/72 |
| 4,759,657 | A | 7/1988 | Dorr et al. | |
| 5,356,238 | A | 10/1994 | Musil et al. | |
| 5,362,177 | A | 11/1994 | Bowhall et al. | |
| 5,401,115 | A * | 3/1995 | Musil et al. | 404/72 |
| 5,549,412 | A | 8/1996 | Malone | |
| 5,599,134 | A | 2/1997 | Macku et al. | |
| 5,702,201 | A | 12/1997 | Macku et al. | |
| 5,752,783 | A | 5/1998 | Malone | |
| 5,879,104 | A | 3/1999 | Ulrich | |
| 5,942,679 | A * | 8/1999 | Sandstrom | 73/78 |
| 5,952,561 | A * | 9/1999 | Jaselskis et al. | 73/78 |
| 5,984,420 | A | 11/1999 | Murray et al. | |
| 6,520,715 | B1 | 2/2003 | Smith | |
| 6,558,072 | B2 * | 5/2003 | Staffenhagen et al. | 404/117 |
| 6,742,960 | B2 | 6/2004 | Corcoran et al. | |
| 6,749,364 | B1 * | 6/2004 | Baker et al. | 404/84.5 |
| 6,752,567 | B2 * | 6/2004 | Miyamoto et al. | 404/84.1 |
| 6,799,922 | B2 | 10/2004 | Smith | |
| 7,089,823 | B2 * | 8/2006 | Potts | 74/553 |
| 7,172,363 | B2 | 2/2007 | Olson et al. | |
| 7,669,458 | B2 * | 3/2010 | Commuri et al. | 73/32 A |
| 2007/0239336 | A1 | 10/2007 | Congdon et al. | |
| 2007/0239338 | A1 | 10/2007 | Potts et al. | |
| 2008/0063473 | A1 | 3/2008 | Congdon et al. | |

OTHER PUBLICATIONS

Glee et al., Paving System and Method, pending U.S. Appl. No. 11/998,660 (25 pages) and drawings (4 pages), filed Nov. 30, 2007.

* cited by examiner

*Primary Examiner* — Thomas B Will
*Assistant Examiner* — Abigail A Risic
(74) *Attorney, Agent, or Firm* — Liell & McNeil

(57) ABSTRACT

A paving system includes a machine having a plurality of ground-engaging elements and a frame. The machine may be a paving machine having a receiver configured to receive electronic data indicative of a non-uniformity in a substrate within a region to be paved with a mat of paving material. The paving system further includes an electronic control unit configured to control compactor interaction with the mat of material according to a mat smoothness criterion, including controlling compactor interaction with the mat of material in response to data, such as screed control data, indicative of the non-uniformity in the substrate.

20 Claims, 2 Drawing Sheets

PAVING SYSTEM AND METHOD FOR CONTROLLING COMPACTOR INTERACTION WITH PAVING MATERIAL MAT

TECHNICAL FIELD

The present disclosure relates generally to machines and control strategies used in compacting a material, and relates more particularly to commanding a change in compactor interaction with a mat of material responsive to data indicative of a non-uniformity in a substrate.

BACKGROUND

A wide variety of relatively sophisticated machines, processes and control strategies are used in connection with site preparation for construction, road building and related projects. In a paving operation, for example, numerous different machines may be used, each of which may be in communication with one another or with a base station where a site manager or computer can monitor progress and make adjustments as necessary. Computer control over various functions of machines used in a paving system is increasingly an effective tool for achieving quality specifications for a particular project. Many machines used in paving are relatively expensive to operate, and contract payments for a particular project are often based on achieving or exceeding contractual requirements. For example, specifications relating to density of the paving material, conditions such as temperature during its application, and in some instances smoothness of the final product are often predefined. Moreover, where specifications are not met, expensive and time-consuming re-work may be required. Accordingly, even modest improvements in paving efficiency or quality are welcomed by the industry.

As mentioned above, smoothness of a mat of paving material may be specified for a particular paving project. It has been discovered that relatively smoother pavement tends to have a longer service life, or at least longer service life at a reasonable level of quality, than relatively rougher pavement. One factor that appears to be responsible for this discrepancy is the relatively high inertial load imparted to bumps, dips or other irregularities in a paved surface by traffic passing over the paved surface. In certain jurisdictions, increased responsibility has been urged upon paving contractors for the long-term durability of roads, parking lots and the like. It will thus be appreciated that paving contractors may complete projects more efficiently, profitably and with greater long-term reliability if they are able to produce a product which is relatively smoother than that possible with conventional techniques.

In preparing a site for paving, building construction, etc., or during the paving process itself, compactors are commonly used to prepare a substrate for bearing loads relating to traffic, structural support, etc. While the end use of a particular substrate may dictate desired compaction specifications for a particular material, in general compaction is achieved by driving, pushing or towing a machine having rotating drums across the substrate of interest to increase its density and uniformity. Compactors are often equipped with vibratory apparatuses to increase and control energy transfer between the compactor and the substrate. It has been observed that different substrates, and similar substrates having different qualities such as moisture level, thickness and other qualities, will tend to respond differently to compactor interaction with the substrate. In recent years, certain manufacturers have experimented with compactor control strategies and compaction progress monitoring, in an attempt to account for differing responses of material to compactor interaction therewith. The response of a material to compactor interaction can affect the smoothness that is ultimately achievable, particularly for a mat of paving material.

Another consideration in attempting to pave a relatively smooth mat is the condition of the subgrade upon which the mat is to be paved. Various machines are known in the art for preparing a subgrade prior to paving a mat of paving material thereon, such as cold planers, recyclers and other reclaiming machines. In general, these machines travel across a region of a work area upon which a mat of material is to be paved, and process the existing material, either by grinding up, mixing and re-depositing the material, or by cutting away a layer of material for disposal elsewhere. While such machines can remove irregularities in a subgrade, resulting in a relatively smoother mat, there is a limit to the extent to which processing subgrade materials is economically practicable, or for that matter even feasible. As a result, paving contractors are often required to pave relatively rough subgrades, but expected to produce relatively smooth results.

U.S. Pat. No. 5,702,2012 Macku et al. is directed to a method for compensating differential compaction in an asphalt paving mat. In Macku et al. an asphalt paver has a compaction compensating system that includes a nominal reference for determining the general profile of underlying terrain, and a compensating ski for determining localized irregularities. A control system alters the thickness of the mat being placed by the paver to compensate for differential compaction of the asphalt material such that a generally planar asphalt paving surface is obtained after compaction. While Macku et al. may have certain applications, under filling and over filling an irregular profile assumes that compactors will interact consistently and uniformly with the entire work area being paved, which is not always the case, or even desirable. Moreover, it can be difficult or impossible to achieve smoothness specifications solely by way of such techniques.

SUMMARY

In one aspect, a method of operating a paving system includes a step of receiving electronic data indicative of a non-uniformity in a substrate within a region to be traversed via a compactor. The method further includes a step of commanding compactor interaction with a mat of material within the region according to a mat smoothness criterion, and still further includes a step of commanding a change in the compactor interaction with the mat of material in response to the electronic data.

In another aspect, a paving system includes a machine, having a frame and a plurality of ground-engaging elements coupled with the frame. The paving system further includes a receiver resident on the machine and configured to receive electronic data indicative of a non-uniformity in a substrate. The paving system further includes an electronic control unit configured via outputting compactor control commands to control a compactor interaction with a mat of paving material within the region according to a mat smoothness criterion, the electronic control unit being further configured to command a change in the compactor interaction with the mat of material in response to the electronic data.

In still another aspect, a paving control system includes an electronic control unit configured to receive electronic data indicative of a non-uniformity in a substrate within a region to be paved via a paving machine with a mat of paving material. The electronic control unit is further configured via outputting control commands to a compactor to control a compactor interaction with the mat according to a mat smoothness criterion, and still further configured to command a change in the compactor interaction with the mat of material in response to the electronic data.

DETAILED DESCRIPTION

Figure 1:
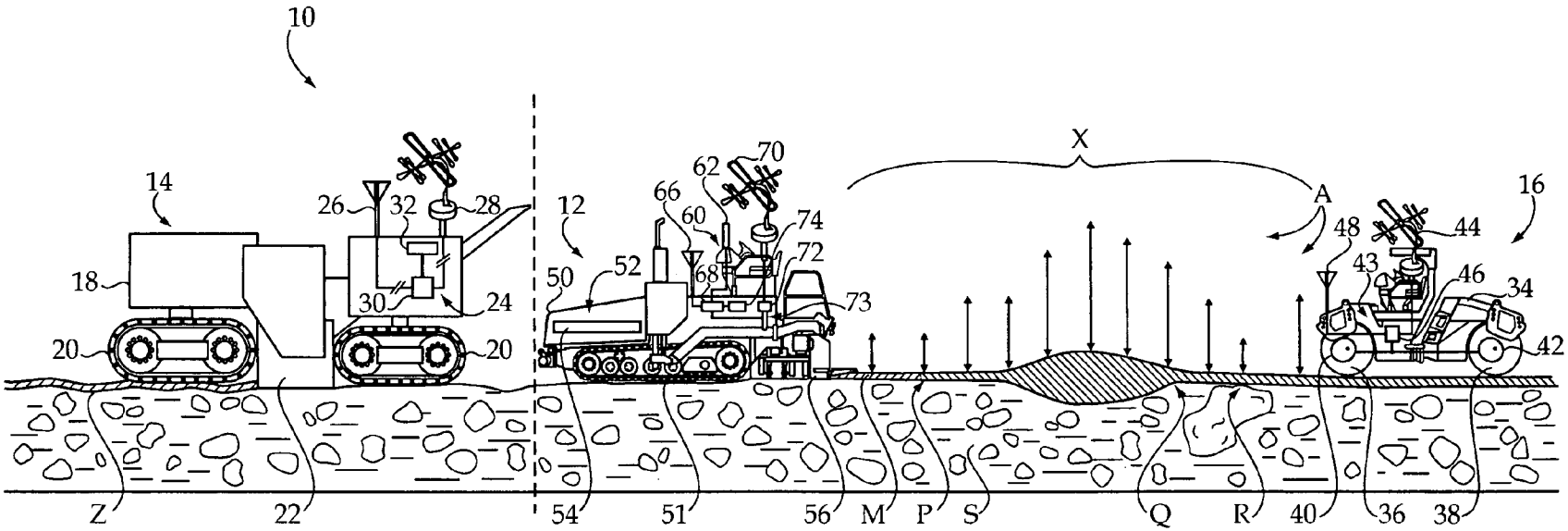
FIG. 1 is a side diagrammatic view of a paving system according to one embodiment.

Referring to FIG. 1, there is shown a paving system 10 according to one embodiment. Paving system 10 may include a plurality of different machines, and in the illustrated embodiment includes a paving machine 12, a compactor 16 and a third machine such as a cold planer or reclaimer 14. The various machines of paving system 10 are shown approximately as they might appear during paving a new paving material mat M on a subgrade S. Machine 14 is shown in the process of removing or recycling an existing paving material mat Z from subgrade S, whereas paving machine 12 is traveling across subgrade S and depositing new mat M, which is subsequently compacted by compactor 16. As further described herein, paving system 10 may be configured to control interaction of compactor 16 and optionally additional compactors with mat M to optimize paving smoothness.

Paving machine 12 may include a frame 50 which includes a hopper 52 for temporarily storing a paving material, such as an asphalt comprising an aggregate and a binder, and a conveyor 54 configured to move paving material from hopper 52 through paving machine 12, and onto subgrade S for conventional leveling, preliminary compacting, thickness control, etc., via a height adjustable screed 56. Paving machine 12 may further include a plurality of ground-engaging elements 51, such as wheels or tracks configured to propel paving machine 12, and an operator station 60. Paving machine 12 may further include a paving control system 64, having an electronic control unit 68, a computer readable memory 74, and a display 62 located at operator station 60 or elsewhere for viewing by an operator. Many paving machines have multiple displays, whereby multiple operators can monitor and/or control subsystems and functions of paving machine 12. Thus, paving machine might include a first display at operator station 60, display 62, and one or more additional displays (not shown) such as a display in proximity to screed 56. Electronic control unit 68 is resident on paving machine 12 in one practical implementation strategy. Various control functions executed by electronic control unit 68, however, might alternatively be performed via an electronic control unit that is not resident on paving machine 12. Descriptions herein of features of electronic control unit 68 and actions taken via electronic control unit 68 should therefore be understood to refer similarly to an electronic control unit not resident on paving machine 12, except as otherwise indicated.

Paving control system 64 may also include a receiver 70, coupled with electronic control unit 68 and a transmitter 66 also coupled with electronic control unit 68. Receiver 70 may be configured to receive signals, such as global positioning signals or local positioning signals, indicative of a position of paving machine 12 relative to a reference position or relative to another machine of paving system 10. Receiver 70 may also be configured to receive data signals from another machine of paving system 10, or from some other data transmitting device. Transmitter 66 may be configured to output control commands from electronic control unit 68 to other machines of paving system 10, such as compactor 16. Electronic control unit 68 may receive signals via receiver 70, or from other devices such as sensors on machine 12. Thus, electronic control unit 68 should also be understood as a "receiver" as that term is used herein. One or more sensors 72 may be provided which are coupled, for example, with a set of screed actuators 73. Sensors 72 may be in communication with electronic control unit 68 and configured to output signals to electronic control unit 68 which are indicative of a vertical position of screed 56 relative to a reference position, such as a predefined reference plane.

In one embodiment, paving machine 12 could include an averaging ski or the like (not shown), and/or one or more sensors such as stringline sensors, sonic sensors, laser or other optical sensors, etc., which acquire data used in controlling a relative height of screed 56, in a manner that will be familiar to those skilled in the paving arts. Controlling a height of screed 56 can vary a thickness of paving material placed via paving machine 12. Typically, paving material may be placed via paving machine 12 at an irregular thickness and defining a surface profile which varies inversely with an irregular surface profile of subgrade S. In other words, relatively thinner sections of paving material of mat M may be placed over bumps in subgrade S and relatively thicker sections of paving material of mat M may be placed over dips in subgrade S. Electronic data received from sensors resident on paving machine 12 such as sensors 72, or via receiver 70, or even recorded electronic profile data for subgrade S, may include screed control data, the significance of which will be apparent from the following description. Screed control data may include any electronic data used by electronic control unit 68 in determining screed control commands for adjusting a height of screed 56 via actuators 73, as well as any electronic data used in monitoring a response of screed 56 to screed control commands. Screed control data may still further include screed control commands themselves, or corresponding signal values.

As mentioned above, machine 14 is shown in the process of cold planing or reclaiming an existing mat of material Z. To this end, machine 14, shown illustratively as a cold planer, may include a frame 18 and a plurality of ground-engaging elements 20 coupled with and supporting frame 18. Machine 14 may further include a machining head 22 or the like, which is configured to remove a portion or all of existing mat Z from subgrade S, in preparation for paving new mat M thereon. Machine 14 may further include a control system 24, having an electronic control unit 30, a receiver 28, a computer readable memory 32 and a transmitter 26. In one embodiment, control system 24 may record profile data for subgrade S on computer readable memory 32. Control system 24 might additionally or alternatively transmit data such as profile data for subgrade S to another machine of paving system 10 via transmitter 26.

Control system 24 may further receive position signals, for example via receiver 28, which may be used in determining the location of features or certain qualities of subgrade S, such as bumps, dips, average smoothness for a given segment, etc. In other words, by receiving position signals, such as local positioning signals or global positioning signals, electronic control unit 30 can associate the position signals or position data with profile data and the like for subgrade S. In one embodiment, machining head 22 may be height adjustable to vary its cutting depth. A history of vertical adjustments of machining head 22 mapped to position on subgrade S might comprise profile data for subgrade S in one embodiment. It will typically be desirable to utilize machine 14 to remove existing mat Z and render a profile for subgrade S which is as smooth as possible. In most instances, however, subgrade S will have an irregular profile after working via machine 14. The profile data for subgrade S could be used in controlling screed 56 and therefore may comprise screed control data as described herein in certain embodiments.

Compactor 16 may include a frame 34, having a front compacting drum 36 and a back compacting drum 38 coupled therewith. Front drum 36 may have a vibratory apparatus 40 associated therewith, whereas back drum 38 may also have a vibratory apparatus 42 associated therewith. Compactor 16 may further include a compactor control system 43 including a receiver 44 configured, for example, to receive position signals similar to receiver 28 of machine 14. Receiver 28 may also receive compactor control commands for controlling compactor 16 as further described herein. Control system 43 may further include an electronic control unit 46, and a transmitter 48, for communicating with other machines of system 10, a control station, etc. In one embodiment, electronic control unit 46 may be configured to receive compactor control commands via receiver 44 and responsively output control commands to vibratory apparatuses 40 and 42 to vary energy transfer between compactor 16 and mat M. Each vibratory apparatus 40 and 42 may have an adjustable vibration amplitude, adjustable vibration frequency and/or adjustable vibration direction. Varying energy transfer could also include turning one or both of vibratory apparatuses 40 and 42 on or off.

As mentioned above, paving system 10 may be configured to control compactor interaction with mat M to optimize paving smoothness. It may be noted from the FIG. 1 illustration that neither of subgrade S nor mat M is entirely uniform. Subgrade S has a non-uniform surface profile and a non-uniform composition, for example. Mat M also has a non-uniform surface profile varying inversely with the non-uniform surface profile of subgrade S and a non-uniform thickness, for example. Non-uniformities in a substrate such as subgrade S or mat M may negatively affect smoothness of mat M unless remedied via controlling compactor interaction with mat M as further described herein. Several other example non-uniformities are shown in FIG. 1. It may be noted that at a point P a transition between two different types of paving materials exists, evident by way of the different sectioning of mat M at point P, which defines a non-uniformity. At point Q, a relatively abrupt change in a thickness of mat M exists which defines a non-uniformity. At point R, a large rock lies close to the surface of subgrade S and also defines a non-uniformity. Each of the non-uniformities shown in FIG. 1 represents one example where interaction with mat M via compactor 16 might be controlled to result in an optimally smooth mat, as further described herein.

During compacting a mat of paving material, compactor 16 may be operated either via electronic or operator control to achieve a given set of paving specifications, one of which may be smoothness. In other words, to achieve a specified result in a given paving job, including a specified smoothness, compactor 16 may be operated a specified way. During compacting mat M, electronic control unit 68 may command a compactor interaction with a given region of mat M according to a mat smoothness criterion. In one embodiment, the smoothness criterion described herein may be a value or range of values corresponding with or correlated to an International Roughness Index value or range of values. The smoothness criterion may include a target smoothness value, for example, after mat M has cooled but prior to traffic passing over mat M.

In another embodiment, the smoothness criterion could include a target smoothness value at a time in the future after subjecting mat M to traffic, weathering, etc. In such an embodiment, the mat smoothness criterion may be understood as a mat smoothness durability criterion. In other words, a mat smoothness durability criterion could be used which accounts for expected changes in smoothness over time and compactor 16 could be controlled in a manner contemplated to result in a given mat smoothness at a time in the future. Different quantitative or qualitative mat smoothness criteria might also be used without departing from the scope of the present disclosure.

Examples of compactor interaction specifications that may be commanded based on the mat smoothness criterion include a number of passes over the subject region, a compactor travel speed or travel direction within the region, a vibration frequency or amplitude or vibration direction to be used when working within a region, and still other parameters. It may be noted that each of these factors may relate generally to net energy transfer between compactor 16 and a given region of mat M. In general terms, if too much energy transfer into mat M from compactor 16 occurs, for example, from too many passes or by way of improper use of vibratory apparatuses 42 or 44, then mat M may be overcompacted. Overcompaction may, immediately or over time, negatively impact mat smoothness either because the paving material can fail and break apart or because overcompaction of certain regions of a mat can result in an uneven surface profile of mat M. If too little energy transfer occurs, then mat M may be undercompacted, which can negatively impact mat smoothness for similar reasons, e.g. failure or unevenness. In still another example, if compactor 16 travels in a different direction across a joint between different regions of mat M than a specified direction, such as traveling perpendicular across a joint between two different types of paving material, the joint region may not compact to as smooth a state as would otherwise be possible, or may prematurely fail or buckle, also compromising smoothness.

It may also be desirable to specify a spacing between compactor 16 and paving machine 12 to produce an optimally smooth mat. If compactor 16 is too close to paving machine 12, it can encounter paving material of mat M which has not yet cooled to an appropriate temperature for compacting. If compactor 16 is traveling too far behind paving machine 12, it may be working paving material that has cooled too much for optimal compacting. In either case, working of paving material that is not at an optimum temperature can result in improper compaction, immediately or eventually leading to a pavement having suboptimal smoothness. In a related vein, compactor travel speed may be specified to maintain a specified spacing between compactor 16 and paving machine 12. It will thus be appreciated that numerous factors relating, to compactor operation and compactor interaction with mat M, "compactor interaction specifications" as described herein, may be controlled based on a mat smoothness criterion.

Operating paving system 10 may also include receiving electronic data indicative of a non-uniformity, such as one of the non-uniformities shown in FIG. 1, in a substrate within a region to be traversed via a compactor such as compactor 16. As used herein, the term "substrate" should be understood to include both subgrade S and paving material mat M. It will therefore be appreciated that the subject non-uniformity might be in either of substrate S or mat M. Electronic control unit 68, or another electronic control unit as described herein, may command a change in the compactor interaction with mat M in response to the electronic data indicative of a non-uniformity.

In one embodiment, receiving the electronic data indicative of a non-uniformity may include receiving data indicative of an irregular profile of at least one of, subgrade S and mat M overlying subgrade S. It will be recalled that machine 14 may store or transmit data associated with a history of vertical position of machining head 22. It will further be recalled that sensors 72 may output position signals associated with vertical position of screed 56. The screed control commands may also be indicative of an irregular profile of at least one of, subgrade S and mat M. Any or all of these sets of electronic data may comprise the electronic data indicative of the irregular profile of the at least one of subgrade S or mat M which is in turn indicative of a non-uniformity in a substrate within a region to be traversed via compactor 16. Other known sensing or scanning techniques might be used to detect non-uniformities in subgrade S or mat M to trigger a commanded change in compactor interaction with mat M, such as via passing a profiler or profilograph across subgrade S prior to placing mat M thereon. It should therefore be appreciated that a wide variety of electronic data may be available which may be indicative of the irregular profile of subgrade S or mat M. The irregular profile may include the non-uniformity, in other words the non-uniformity may be a quality of or a change in the irregular profile, such as the change in the irregular thickness of mat M shown at point Q.

In other embodiments, the non-uniformity might be a relative steepness of a feature in the profile of mat M or subgrade S such as the steepness of a bump, dip, etc., or a variety of other examples such as the rock at point R or the change in material type at point P. It has been observed that non-uniformities in a substrate to be traversed via a compactor such as compactor 16 may negatively impact smoothness of a mat of material unless some action is taken to change compactor interaction with the mat at a mat location associated with the non-uniformity. For example, if compactor 16 were to interact with mat M upon reaching point Q without changing its interaction specifications upon or prior to reaching point Q, sub-optimal compaction and suboptimal smoothness of mat M may occur.

In one embodiment, electronic control unit 68, or another electronic control unit as described herein, may calculate or otherwise determine a change in target energy transfer into the mat responsive to the electronic data indicative of the non-uniformity. Target energy transfer into mat M may be based on a thickness of mat M in a given region. As described above, mat thickness data can be obtained based on the profile of subgrade S, the profile of mat M or the pattern of screed height, for example. Target energy transfer may also be based on the different extent to which a material compacts based on its thickness. For example, since paving material can be expected to compact a certain percentage, relatively thicker paving material compacts a greater absolute amount than relatively thinner regions of paving material. Target energy transfer could also be based on a type of paving material, a temperature of the paving material or still other factors such as environmental factors at a paving site. Since profile data or screed control data, as described above, may be indicative of mat thickness, energy transfer between compactor 16 and mat M may be controlled responsive to mat thickness or to data indicative of mat thickness. A commanded change in energy transfer between compactor 16 and mat M may occur when compactor 16 is at a mat location associated with a non-uniformity, such as when compactor 16 is passing over a non-uniformity or just prior to compactor 16 passing over a non-uniformity.

In an embodiment where a change in mat thickness, such as at point Q, defines the non-uniformity, electronic control unit 68, or another electronic control unit as described herein, may command a change in at least one of, compactor travel speed, compactor travel direction or energy output of vibratory apparatus 42 and/or 44. The time that compactor 16 spends in a given region of mat M, the number of times compactor 16 passes over a region of mat M and the energy output of vibratory apparatuses 42 and 44 each determine in part the net energy that is transferred between compactor 16 and mat M, and may thus each be controlled for the purposes described herein, namely, achieving an optimally smooth mat. It will thus be appreciated that electronic control unit 68 may output control commands via transmitter 66, for example, which are received via receiver 44 of compactor control system 43. During operation, compactor control system 43 may be receiving position data via receiver 44 and may command a change in energy transfer between compactor 16 and mat M in response to position data which indicates that compactor 16 has reached or is about to reach a mat location associated with a non-uniformity.

INDUSTRIAL APPLICABILITY

Figure 2:
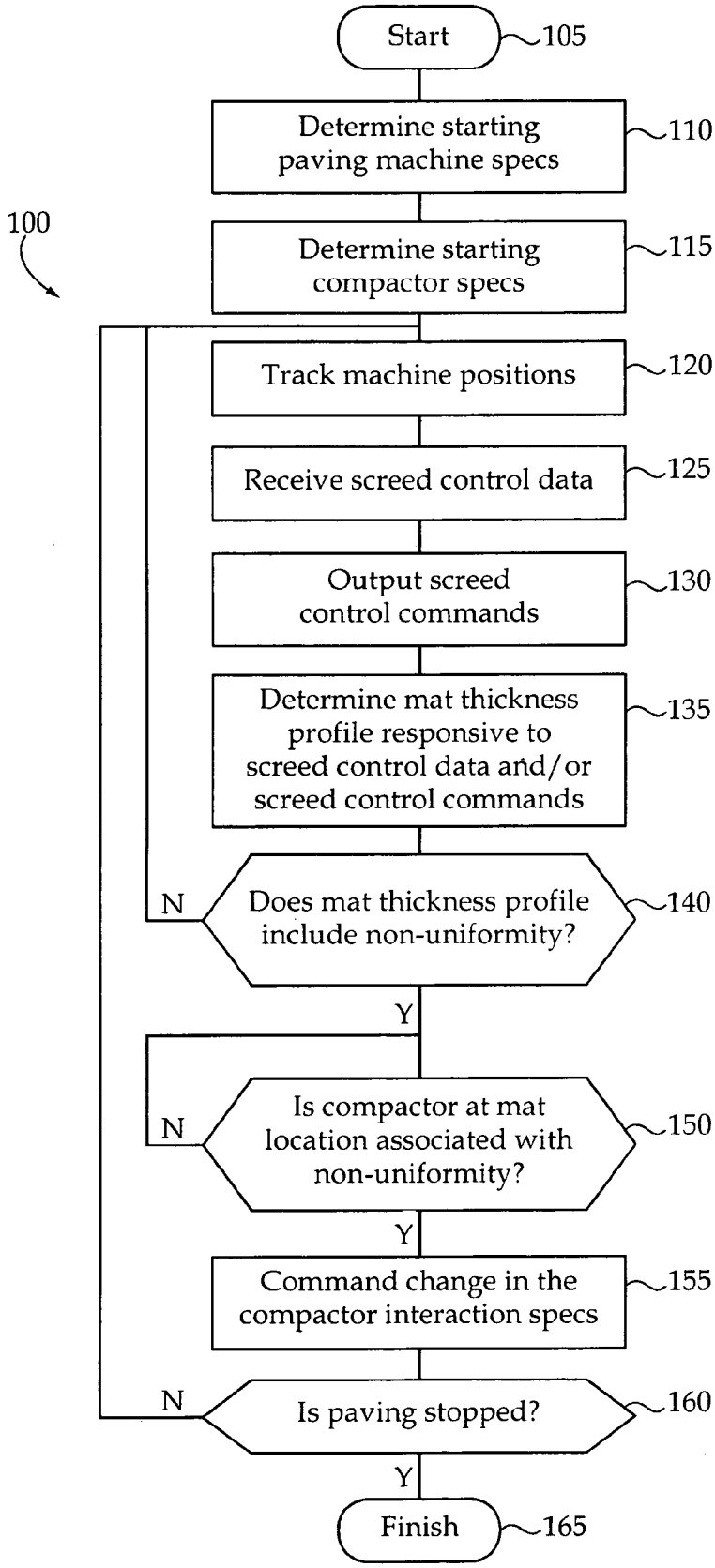
FIG. 2 is a flowchart illustrating a control process, according to one embodiment.

Turning now to FIG. 2, there is shown a flowchart 100 illustrating an example control process according to one embodiment. The process of flowchart 100 may start at step 105, and may then proceed to step 110 to determine starting paving machine specifications. Starting paving machine specifications may include a paving machine speed, a material feed rate for conveyor 54 and also starting screed specifications such as screed height, screed angle of attack, for example. From step 110, the process may proceed to step 115 to determine starting compactor specifications. Starting compactor specifications might include compactor speed, travel direction and other factors relating to energy transfer between compactor 16 and mat M, for example, as described herein. In general, it will be desirable to proceed with paving in a planned manner. As discussed above, compactor interaction specifications for interacting with mat M, including starting specifications, may be based on a mat smoothness criterion. The starting specifications for paving machine 12 and also for compactor 16 may in one embodiment be based on knowledge of a profile of a surface to be paved, such as knowledge of an irregular profile of substrate S, obtained during previous paving passes with machine 12, with machine 14, or via some other data gathering means such as a profiler or profilograph.

From step 115, the process may proceed to step 120 to track machine positions, including positions of paving machine 12 and compactor 16. At step 120, the process could also include querying whether paving is actually taking place, such as by determining whether conveyor 54 is being operated or by monitoring various other parameters. If paving is not taking place, for example where paving machine 12 and compactor 16 are roading, the process could loop back or exit. In any event, tracking machine position could include establishing a starting position relative to a reference position, and subsequently receiving position signals to enable real time determining of where machines 12 and 16 are located on mat M or relative to one another. From step 120, the process may proceed to step 125 to receive screed control data. As discussed herein the screed control data could include a variety of different types of data used in controlling a vertical position of screed 56 to vary a profile of mat M and thus vary a thickness of mat M.

In the FIG. 1 example, mat M is being paved on a surface of subgrade S. It should be appreciated, however, that mat M might be paved on top of another mat of material. For instance, an existing mat of material such as mat Z might be in appropriate condition for paving over with mat M, after being worked via machine 14 or even without being worked via machine 14. It is also common for multiple lifts of paving material to be used, so the screed control data could relate to profile data for a first lift of material which is to be paved over with a second lift of material, mat M. From step 125, the process may proceed to step 132 to output screed control commands in response to the screed control data. It will further be recalled that the screed control commands may be calculated on the basis of profile data for subgrade S. Thus, electronic control unit 68 may be calculating a pattern of vertical heights for screed 56, based on the screed control data, and outputting commands to actuators 73 to vary screed height inversely with the profile of subgrade S.

From step 130, the process may proceed to step 135 wherein electronic control unit 68 may determine a mat thickness profile responsive to the screed control data and/or the screed control commands. Mat thickness profile may be a mat thickness value plotted against position, for example. From step 135, the process may proceed to step 140 wherein electronic control unit 68 may query whether the mat thickness profile includes or defines a non-uniformity. For example, at step 140 electronic control unit 68 may query whether mat M has an absolute thickness at any point which is greater than "Y" or less than "V." In other words, the question whether a non-uniformity is present might depend on whether the thickness of mat M exceeds a first predefined thickness at any point, or is less than a second predefined thickness at any point. In either case, special treatment with compactor 16 such as a change in energy transfer from compactor 16 to mat M may be appropriate. As discussed above, there are other examples of non-uniformities which might justify a change in compactor interaction with mat M such as a change in paving material type. It is common to use different paving material types for road intersections than for other stretches of road, hence, a non-uniformity might exist where a given stretch of road meets an intersection. Point P in FIG. 1 is illustrative of such a non-uniformity. Aberrations in the underlying subgrade, such as is shown at point R in FIG. 1 might also call for a change in compactor interaction, such as slower compactor travel speed, faster speed, greater or fewer passes, greater or less vibration output, etc., or simply an alert to a compactor operator to proceed with caution.

If at step 140 it is determined that a non-uniformity is not present, the process may return to execute steps 125-140 again. If a non-uniformity is indicated by the mat thickness profile, then the process may proceed to step 150 wherein electronic control unit 68 may query whether compactor 16 is at a mat location associated with the non-uniformity. If no, the process may loop back to execute step 150 again. If yes, the process may proceed ahead to step 155 to command a change in the compactor interaction specifications as described herein. From step 155, the process may proceed to step 160 wherein electronic control unit 68 may query whether paving has stopped. If no, the process may return to again execute steps 125-140. If yes, the process may proceed to step 165 to finish.

Returning to FIG. 1, there is shown a region "X" of mat M which includes each of the non-uniformities represented via points R, Q and P. Much of the foregoing description emphasizes detecting a single non-uniformity, then commanding a change in compactor interaction with mat M in response to the non-uniformity. It should be appreciated, however, that in an actual paving process electronic control unit 68 may be commanding numerous adjustments to compactor interaction with mat M to achieve a given smoothness criterion as paving progresses. In FIG. 1, a series of arrow symbols "A" are shown within region X which represent a pattern of compactor interaction with mat M. The relative length of each arrow symbol corresponds to energy transfer between compactor 16 and mat M. Hence, where compactor 16 reaches the non-uniformity corresponding with point R, commanded energy transfer might be relatively lower, for example, whereas when compactor 16 reaches the non-uniformity corresponding with point Q, the change in mat thickness, commanded energy transfer might be relatively greater. When compactor 16 reaches the non-uniformity corresponding with point P, energy transfer might be changed again, for example because the two different types of paving material on opposite sides of point Q are best compacted via different net energy transfer to achieve a given smoothness.

In one embodiment, paving control system 64 may calculate appropriate energy transfer into mat M via compactor 16 on the fly, as paving progresses. In other embodiments, the pattern of energy transfer, and mat locations appropriate for commanding changes in energy transfer might be planned ahead of time. Thus, paving control system 64 may be configured to determine a compactor interaction plan for compacting mat M which is based on electronic data indicative of non-uniformities in a substrate such as subgrade S or mat M. In such an embodiment, paving control system 64 or another control system might calculate target energy transfer and map target energy transfer based on electronic data acquired during or prior to commencing paving. Energy transfer could include output of vibratory apparatuses 40 and 42, compactor travel speed or travel direction or number of compactor passes, for example. A compactor interaction plan could further include an electronic compactor interaction plan recorded in computer readable memory and having a travel speed term, a vibratory output term, or a compactor pass number term, for example. Appropriate control commands for compactor 16 could be uploaded to compactor control system 43 in advance of paving, or periodically outputted to compactor; 16 as paving progresses. In still other embodiments, rather than relying on data provided from another machine, compactor 16 could be equipped with sensors for sensing non-uniformities in mat M during compacting mat M, and responsively changing the interaction of compactor 16 with mat M in the manner described herein, but completely independently of other machines of paving system 10.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent from an examination of the attached drawings and appended claims.

What is claimed is:

1. A method of operating a paving system comprising the steps of:

receiving electronic data via an electronic control unit resident on a first machine of the paving system, the electronic data being indicative of a uniformity or non-uniformity in a substrate within a region yet to be traversed via a compactor, and the first machine including one of, a paving machine having a screed and another machine configured to travel across the substrate in advance of the paving machine;

commanding interaction of the compactor with a mat of material within the region and overlying the substrate, according to a mat smoothness criterion and such that a compacting drum of the compactor rotates in contact with the mat of material and the compactor compacting the mat of material at a first location to a first extent of compaction by transferring a first net energy to the mat of material based on the electronic data received indicating a uniformity in the substrate; and commanding a change in the compactor interaction with the mat of material according to the mat smoothness criterion and in response to the electronic data, such that the compactor interaction is changed upon reaching and commencing compacting the mat at a second location associated with the non-uniformity and yet to be traversed via the compactor, and the compactor compacting the mat of material at the second location to a second, different extent of compaction by transferring a second, different net energy to the mat of material based on the electronic data received indicating a non-uniformity in the substrate.

2. The method of claim 1 wherein the step of receiving includes receiving data indicative of an irregular profile of at least one of, a subgrade within the region or another mat of material which includes a paving material overlying the subgrade.

3. The method of claim 2 wherein the step of receiving includes receiving electronic data indicative of an irregular mat thickness which defines the non-uniformity.

4. The method of claim 3 further comprising a step of placing paving material on the surface via the paving machine at an irregular mat thickness.

5. The method of claim 4 further comprising a step of receiving screed control data, wherein the step of placing further includes placing material on the surface at the irregular thickness at least in part by outputting screed control commands for adjusting a height of the screed of the paving machine in response to the screed control data, and wherein the step of receiving electronic data includes receiving the screed control data.

6. The method of claim 4 further comprising a step of controlling energy transfer between the compactor and the mat of material based at least in part on the irregular mat thickness via the step of commanding compactor interaction, and wherein the step of commanding a change in compactor interaction includes commanding a change in the energy transfer.

7. The method of claim 6 wherein the step of commanding a change includes commanding a change in at least one of, compactor travel speed, compactor travel direction or energy output of a vibratory apparatus of the compactor.

8. The method of claim 1 wherein the step of commanding includes commanding compactor interaction with the mat of material according to a mat smoothness durability criterion.

9. The method of claim 1 wherein the step of receiving electronic data includes receiving a first set of data which includes profile data for a subgrade within the region and receiving a second set of data which includes profile data for a mat of material which includes a paving material overlying the subgrade.

10. A paving system comprising:

a first machine, including a frame having a plurality of ground engaging elements coupled with the frame, and the first machine including one of, a paving machine having a screed and another machine configured to travel across the substrate in advance of the paving machine;

a receiver resident on the first machine and configured to receive electronic data indicative of a uniformity or non-uniformity in a substrate within a region; and an electronic control unit configured via outputting compactor control commands to control interaction of a compactor with a mat of paving material within the region and overlying the substrate according to a mat smoothness criterion and such that a compacting drum of the compactor rotates in contact with the mat of material and the compactor compacts the mat of material at a first location to a first extent of compaction by transferring a first net energy to the mat of material based on the electronic data received indicating a uniformity in the substrate; and the electronic control unit being further configured to command a change in the compactor interaction with the mat of material according to the mat smoothness criterion and in response to the electronic data, such that the compactor interaction is changed upon reaching and commencing compacting the mat at a second location associated with the non-uniformity and yet to be traversed via the compactor, and the compactor compacts the mat of material at the second location to a second, different extent of compaction by transferring a second, different net energy to the mat of material based on the electronic data received indicating a non-uniformity in the substrate.

11. The paving system of claim 10 wherein the first machine includes the paving machine, and further comprising a paving control system resident on the paving machine and including the electronic control unit and the receiver.

12. The paving system of claim 11 wherein the paving control system includes at least one sensor mounted on the first machine, the at least one sensor being in communication with the receiver and configured to output signals to the receiver which comprise the electronic data.

13. The paving system of claim 12 further comprising a compactor having a second receiver configured to receive the compactor control commands, the compactor including a compactor control system configured to adjust an energy transfer between the compactor and the mat of material in response to the commanded change.

14. The paving system of claim 13 wherein the compactor includes a vibratory apparatus controllably coupled with the compactor control system and having an energy output which is adjustable in response to the compactor control commands.

15. The paving system of claim 12 wherein the paving machine includes a variable height screed and the paving control system is configured to control a thickness of paving material deposited via the paving machine at least in part by commanding adjusting a height of the screed.

16. A paving control system comprising:

an electronic control unit resident on a first machine and configured to receive electronic data indicative of a uniformity or non-uniformity in a substrate within a region to be paved with a mat of paving material, the first machine including one of, a paving machine having a screed and another machine configured to travel across the substrate in advance of the paving machine;

the electronic control unit being further configured via outputting control commands to a compactor to control a compactor interaction with the mat of material according to a mat smoothness criterion and such that a compacting drum of the compactor rotates in contact with the mat of material and the compactor compacts the mat of material at a first location to a first extent of compaction by transferring a first net energy to the mat of material based on the electronic data received indicating a uniformity in the substrate; and the electronic control unit being further configured to command a change in the compactor interaction with the mat of material according to the mat smoothness criterion and in response to the electronic data, such that the compactor interaction is changed upon reaching and commencing compacting the mat at a second location associated with the non-uniformity and yet to be traversed via the compactor, and the compactor compacts the mat of material at the second location to a second, different extent of compaction by transferring a second, different net energy to the mat of material based on the electronic data received indicating a non-uniformity in the substrate.

17. The paving control system of claim 16 further comprising a transmitter, wherein the electronic control unit is configured to receive data indicative of an irregular mat thickness which defines the non-uniformity, the electronic control unit being further configured to calculate a target energy transfer between the compactor and the mat of paving material based at least in part on the irregular mat thickness and output the compactor control commands via the transmitter to the compactor.

18. The paving control system of claim 17 including a receiver configured to receive position data indicative of a location on the mat of paving material which is associated with the non-uniformity, and wherein the electronic control unit is further configured to command a change in energy transfer between the compactor and the mat of material in response to the position data.

19. The paving control system of claim 16 wherein the electronic control unit is configured to determine a compactor interaction plan for compacting the mat of material in response to the electronic data, the compactor interaction plan including a compactor travel speed term, a compactor pass number term or a vibratory output term.

20. The paving control system of claim 16 further comprising at least one sensor coupled with the electronic control unit and configured to output screed control data which includes the electronic data indicative of a non-uniformity, the electronic unit being configured to output screed control commands to control a height of the screed of the paving machine in response to the screed control data.

* * * * *